US006035926A

United States Patent [19]

Westerlund

[11] Patent Number: 6,035,926

[45] Date of Patent: Mar. 14, 2000

[54] ROTARY, REGENERATIVE HEAT EXCHANGER HAVING HYDRAULIC MOTOR MOTION

[75] Inventor: Dag Westerlund, Saltsjö-Boo, Sweden

[73] Assignee: ABB Air Preheater Inc., Wellsville, N.Y.

[21] Appl. No.: 09/101,482

[22] PCT Filed: Feb. 7, 1997

[86] PCT No.: PCT/SE97/00184

§ 371 Date: Jul. 15, 1998

§ 102(e) Date: Jul. 15, 1998

[87] PCT Pub. No.: WO97/29334

PCT Pub. Date: Aug. 14, 1997

[30] Foreign Application Priority Data

Feb. 8, 1996 [SE] Sweden ..... 9600455

[51] Int. Cl.[7] ..... F23L 15/02

[52] U.S. Cl. ..... 165/8; 165/6; 165/10

[58] Field of Search ..... 165/8, 10, 4, 6

[56] References Cited

U.S. PATENT DOCUMENTS

| | | | |
|---|---|---|---|
| 3,687,192 | 8/1972 | Pettersson . | |
| 4,418,742 | 12/1983 | Conde et al. | 165/8 |
| 4,557,318 | 12/1985 | Bellows | 165/8 |
| 4,627,485 | 12/1986 | Osborn | 165/10 |
| 5,482,108 | 1/1996 | Essle et al. | 165/8 |

FOREIGN PATENT DOCUMENTS

| | | |
|---|---|---|
| 1305232 | 1/1973 | United Kingdom . |
| WO 95/18930 | 7/1995 | WIPO . |

*Primary Examiner*—Christopher Atkinson
*Attorney, Agent, or Firm*—Frishauf, Holtz, Goodman, Langer & Chick, P.C.

[57] ABSTRACT

A rotary, regenerative heat exchanger includes an inner cylindrical hub (2) provided in a vertical position, a rotor (1) containing a heat exchange medium, first attachment members (30) for attaching the rotor to the hub, and a stationary casing (6) surrounding the rotor. A bearing (3) is provided to journal a lower end of the hub, and a slow moving hydraulic motor (4) is adapted to slowly turn the hub. The motor is provided with a housing enclosing a built-in radial bearing (26) and coaxially therewith a cylinder block and cam surface arrangement having a circular cylinder block (24) and a cam surface (21) surrounding the cylinder block and cooperating with a piston mechanism (22, 23) of the cylinder block such that reciprocation of the piston mechanism causes relative motion between the cylinder block and the cam surface. Second attachment members (5, 8, and 10) are provided to attach the motor to the stationary casing and to the hub, respectively. And an upper bearing of the hub consists only of a combination of the built-in radial bearing of the motor and the cylinder block and cam surface arrangement.

2 Claims, 2 Drawing Sheets

ROTARY, REGENERATIVE HEAT EXCHANGER HAVING HYDRAULIC MOTOR MOTION

BACKGROUND OF THE INVENTION

Hydraulic motors of the slow moving type are usually designed to be very sturdy and adapted to sustain hard stress. Therefore they have proved to be very suitable for the low speed turning of the rotary air preheater.

Therefore they have been mounted in the casing of the heat exchanger just outside the radial bearing with the rotating part of the hydraulic motor secured to the end of the hub. The hub is, however, subject to very high mechanical stress, partly caused by the strong temperature variations present in a regenerative heat exchanger. This shows itself a.o. by bending motions of the hub resulting in a tendency of the fastening of the hydraulic motor to the casing to break apart by radially directed forces emanating from the radial bearing.

This drawback has been eliminated by making the attachment of the motor flexible for radial forces and non-rotatable to all other forces, as shown in U.S. Pat. No. 3,687,192. This solution has proved not quite reliable due to endurance damages to the motor attachment.

OBJECT OF THE INVENTION

The object of the invention is to achieve a rotary, regenerative heat exchanger with a hydraulic motor motion that avoids the above mentioned drawbacks.

This has been achieved according to the invention in a simple way in that said radial bearing is the hydraulic motor with its built-in bearing means. No bending forces can occur because the radial bearing and the bearing of the motor is one and the same bearing. Moreover, the combination of motor and radial bearing is less space consuming and easier to mount as compared to previously known structures where the particular radial bearing needs provision of lubricating oil pipes and maintenance demanding seals and so on.

DETAILED DESCRIPTION

Figure 1:
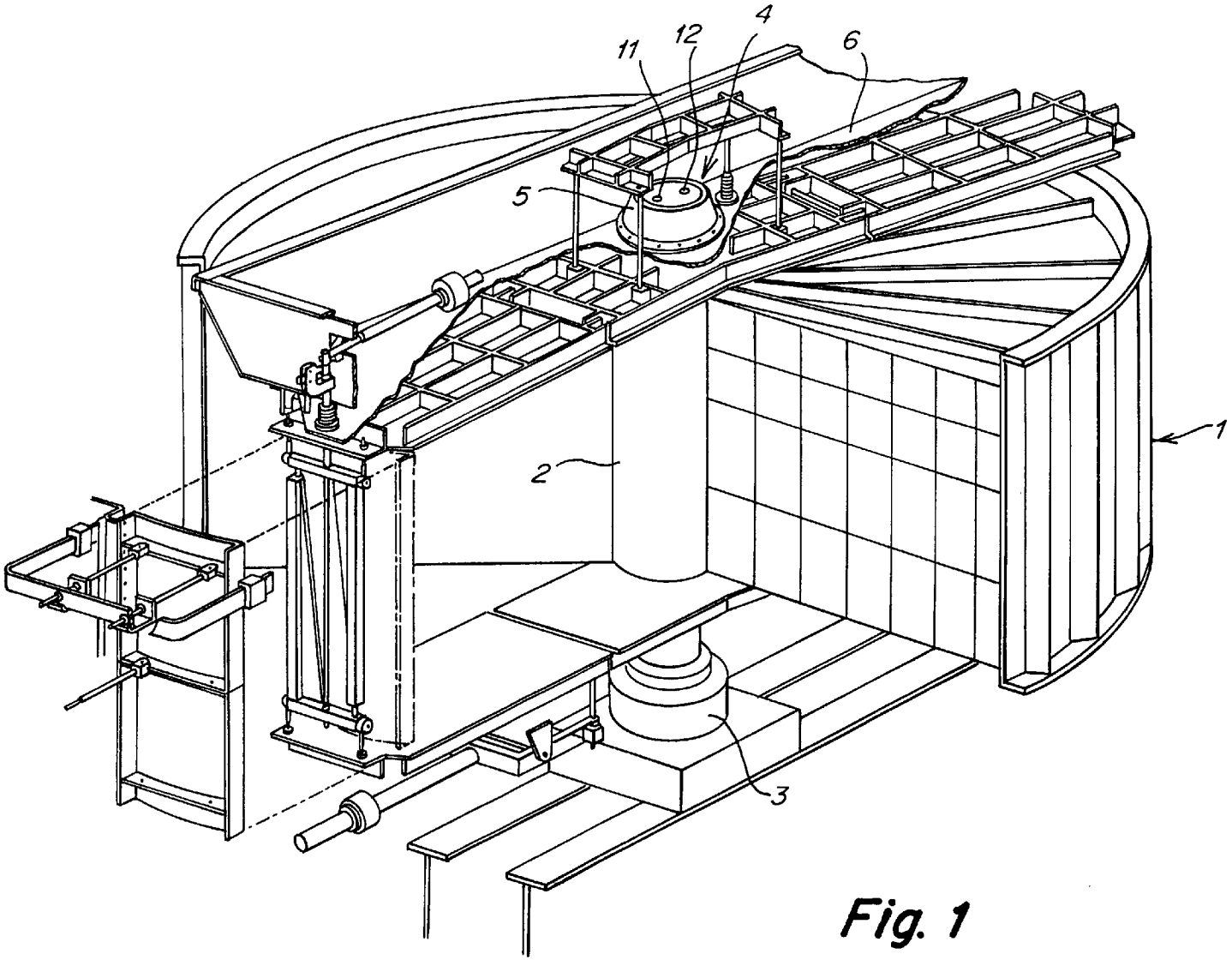
Figure 2:
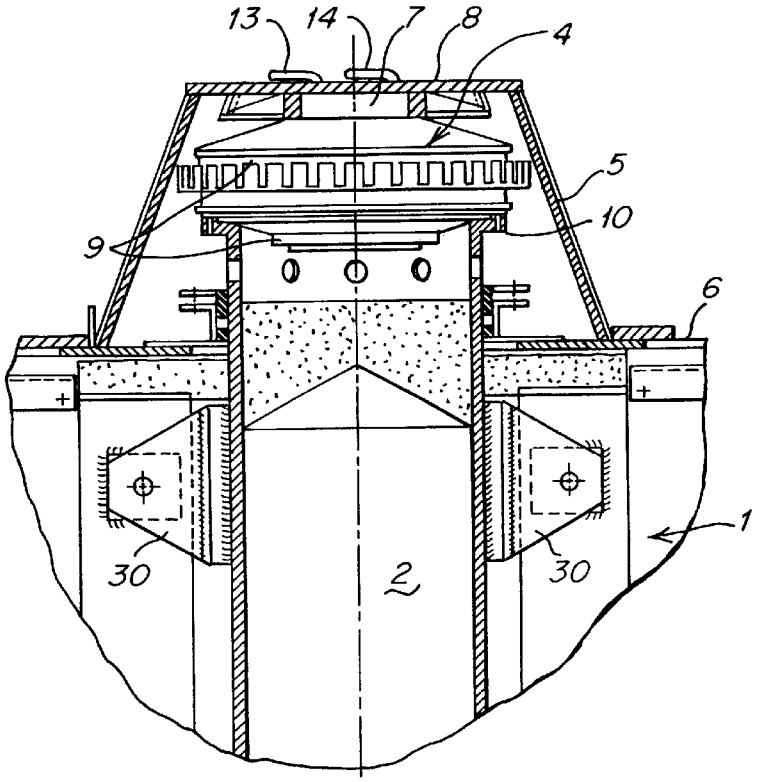
Figure 3:
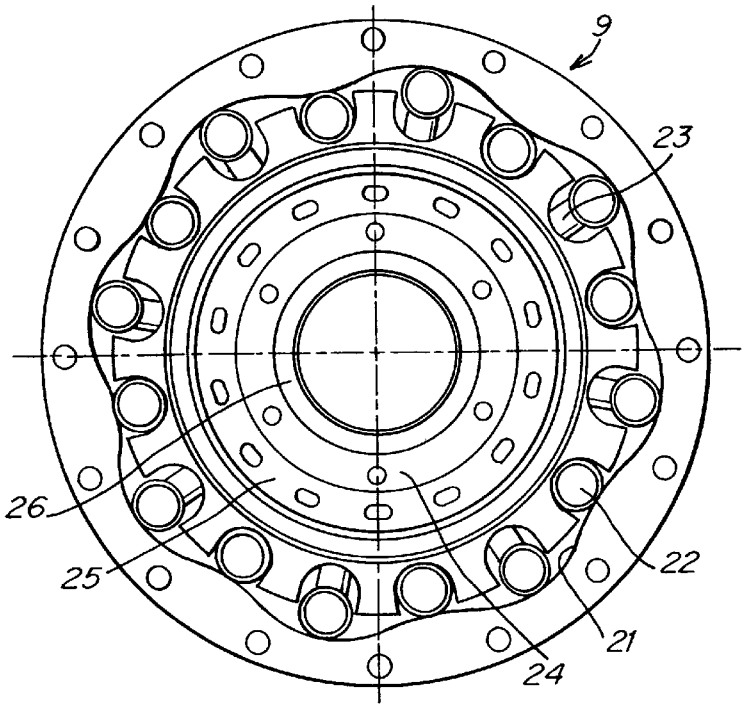

A preferred embodiment of the invention will now be described with reference to the accompanying drawings, in which FIG. 1 is a perspective view by way of example of an embodiment of a rotor with portions cut away to show the hub of the rotor with upper and bottom bearings, FIG. 2 is a longitudinal section through the upper part of the hub and adjacent parts of the rotor and the casing of the heat exchanger and with the cup of the motor cut away, and FIG. 3 is an end view of a particularly suitable hydraulic motor with its bottom portion cut away for showing the interior parts of the motor.

FIG. 1 discloses schematically a rotor 1 with a portion cut away to show the vertical, cylindrical hub 2, the bottom portion of which is supported by a thrust bearing 3 and the top portion of which is guided by a hydraulic motor 4 provided with a built-in radial bearing 26 (shown in FIG. 3). The motor is fixedly mounted in a cap 5, which is bolted to the casing 6 of the heat exchanger via brackets 30, as shown in FIG. 2. Only the upper and the bottom bearings and upper and bottom sector plates and associated sealing means are shown of the casing 6, since the casing is a known, conventional casing.

Suitable hydraulic motors are available on the market in different designs. FIG. 2 shows a hydraulic motor 4 with a stationary part 7 fixedly attached to the inside of the roof 8 of the cap 5. The housing 9 of the motor is rotatably journalled to the stationary part 7 by the built-in radial bearings 26 shown in FIG. 3, and has a bottom part fitted in the open top end of the hub 2 which is provided with a flange 10 to which the rotatable housing 9 of the motor is attached. Connections 11,12 (FIG. 1) to a pressure oil pipe 13 and a return pipe 14 are located on the roof 8 of the cap 5 (FIG. 2) for driving the hydraulic motor 4.

The essential parts of the interior of the hydraulic motor 4 are shown in FIG. 3. The inside of the housing 9 is provided with a wave shaped, closed cam surface 21 against which an even number of cam rolls 22 are arranged to roll. The cam rolls 22 are directed axially and are rotatably journalled in a cylinder block 24 fixedly attached to the part 7.

Pressure oil is supplied to the motor 4 from a pressure oil pipe 13 and via a valve plate 25 to the pistons 23 when their corresponding cam rolls 22 are in such a position in relation to the cam surface 21 that the cam rolls 22 force the cam surface 21 and accordingly the housing 9 to rotate in the right direction. The return oil is fed via the valve plate 25 from the pistons 23 to the return pipe 14. The hydraulic motor 4 is a conventional motor including the built-in radial bearings 26, and a closer description of its operating is not necessary.

The built-in radial bearing 26 of the motor 4 acts in combination with the pressure of the pistons 23 and the rolls 22 towards the cam surface 21 and accordingly the housing 9 makes the hydraulic motor alone capable of taking up the radial forces which may arise at the upper part of the rotor hub 2 such that a special radial bearing of the rotor hub 2 is not necessary. As a result, the drawbacks are avoided of bending forces between the bearings of a hydraulic motor and axially displaced radial bearings of a rotor hub, which bending forces arise at the operation of the heat exchanger. Hence, the invention is based on the knowledge that the complicated radial bearings of a rotor hub including lubricating oil pipes and sealing means may be completely dispensed with if the well-known hydraulic motor is moved from a position in which it causes structural strength problems to the position of the superfluous, conventional radial bearing.

The invention is not limited to the embodiment here shown and described but can be modified in different ways within the scope of the invention defined in the claims. Hence, the housing 9 of the hydraulic motor 4 may be fixedly attached to the casing 6 of the heat exchanger, and the rotary part of the hydraulic motor may be attached to the rotor hub 2, which then suitably has a shaft pivot protruding into the now rotary part (i.e., the built-in radial bearing 26) of the hydraulic motor 4.

I claim:

1. A rotary regenerative heat exchanger comprising:

an inner cylindrical hub provided in a vertical position;

a rotor containing a heat exchange medium;

first attachment members for attaching said rotor to said hub;

a stationary casing surrounding said rotor;

a bearing journalling a lower end of the hub;

a slow moving hydraulic motor adapted to slowly turn the hub, said motor being provided with a housing enclosing a built-in radial bearing and coaxially therewith a cylinder block and cam surface arrangement comprising a circular cylinder block and a cam surface surrounding the cylinder block and cooperating with a piston mechanism of the cylinder block such that reciprocation of the piston mechanism causes relative motion between the cylinder block and the cam surface; and second attachment members for attaching said motor to the stationary casing and to the hub, respectively, wherein an upper bearing of the hub consists only of a combination of said built-in radial bearing of the motor and said cylinder block and cam surface arrangement.

2. The heat exchanger according to claim 1, wherein said cylinder block is secured to said stationary casing, said cam surface is secured to an inner wall of the housing of the motor, and said housing is attached to a flange of the hub.

* * * * *